US005267374A

United States Patent [19]

Drake

[11] Patent Number: 5,267,374

[45] Date of Patent: Dec. 7, 1993

[54] CLOSURE CLIP FOR PLASTIC BAGS AND SIMILAR ARTICLES

[76] Inventor: Kirk J. Drake, 7221 Candletree La., #88, Lincoln, Nebr. 68506

[21] Appl. No.: 930,265

[22] Filed: Aug. 14, 1992

[51] Int. Cl.[5] ..... A44B 21/00

[52] U.S. Cl. ..... 24/30.5 R; 24/303; 24/501

[58] Field of Search ..... 24/30.5 R, 511, 501, 24/500, 507, 303; 248/206.5

[56] References Cited

U.S. PATENT DOCUMENTS

| | | | |
|---|---|---|---|
| 10,635 | 3/1854 | Haskins | 24/501 |
| 2,466,284 | 4/1949 | Stinne | 24/501 |
| 2,843,899 | 7/1958 | Howard | 24/501 X |
| 4,648,160 | 3/1987 | Spinosa et al. | 24/30.5 R X |
| 4,953,714 | 9/1990 | Paul | 248/206.5 X |

FOREIGN PATENT DOCUMENTS

| | | | |
|---|---|---|---|
| 1287382 | 2/1962 | France | 24/501 |
| 1517477 | 3/1968 | France | 24/501 |
| 440612 | 10/1948 | Italy | 24/501 |

*Primary Examiner*—James R. Brittian
*Attorney, Agent, or Firm*—Richard L. Miller

[57] ABSTRACT

A bag closure clip is provided which consists of a pair of arms, each having a handle at a first end and a jaw at a second end and a hinge mechanism for permitting pivoting the arms to move from an open position in which the jaws are separated to a closed position so that the jaws are together. Another mechanism is provided for biasing the arms to the closed position, so that the jaws are normally together, to make an airtight seal on a plastic bag. When the handles are manually squeezed together the arms will move into an opened position to separate the jaws and release the airtight seal on the plastic bag.

4 Claims, 1 Drawing Sheet

CLOSURE CLIP FOR PLASTIC BAGS AND SIMILAR ARTICLES

BACKGROUND OF THE INVENTION

The instant invention relates generally to tie devices but more specifically it relates to a bag closure clip and similar articles.

Numerous tie devices have been provided in the prior art that are adapted to close plastic bags in a way that their contents are not prematurely spilled therefrom. For example, U.S. Pat Nos. 3,565,738 to Kirkpatrick; 3,974,960 to Mitchell and 4,906,108 to Harrington et al all are illustrative of such prior art. While these units may be suitable for the particular purpose to which they address, they would not be as suitable for the purpose of the present invention as hereafter described.

SUMMARY OF THE INVENTION

A primary object of the present invention is to provide a bag closure clip that will overcome the shortcomings of the prior art devices.

Another object is to provide a bag closure clip that will replace wire ties and plastic tabs, to make an airtight seal for any plastic bag wrapped item to keep it protected.

An additional object is to provide a bag closure clip that is fabricated out of plastic so as to be washable and freezer safe.

A further object is to provide a bag closure clip that is simple and easy to use.

A still further object is to provide a bag closure clip that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
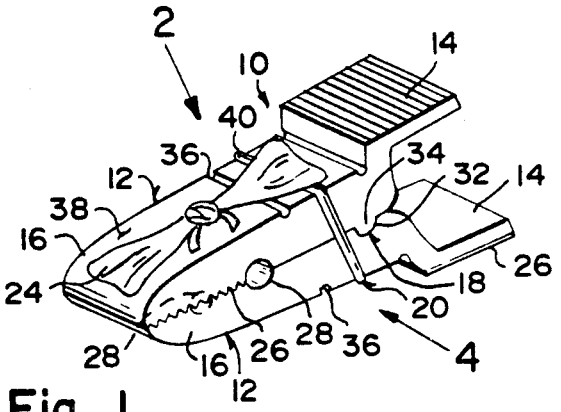
FIG. 1 is a diagrammatic perspective view of the instant invention.

Turning now descriptively to the drawings, in which similar reference characters denote similar elements throughout the several views, the Figures illustrate a bag closure clip 10 which consists of a pair of arms 12, each having a handle 14 at a first end and a jaw 16 at a second end. A mechanism 18 is for permitting pivoting of the arms 12 from an open position in which the jaws 16 are separated to a closed position so that the jaws are together. Another mechanism 20 is for biasing the arms 12 to the closed position, so that the jaws 16 are normally together to make an airtight seal on a plastic bag 22. When the handles 14 are manually squeezed together the arms 12 will move into the opened position to separate the jaws 16 and release the air tight seal on the plastic bag 22.

An ornament 24, typically but not limited to a bow is affixed to one arm 12 to simulate a tie closure. A magnet 26 may be affixed to one handle 14, so that the closure clip 10 can be removably attached to a magnetic surface (not shown).

Each jaw contains a plurality of teeth 26 and has at least one half of a transverse gripping hole 28 on its inner surface 30 to permit the gathering of some of the plastic bag material therein, in order to create a seal which is more likely to be air tight on the plastic bag 22.

The pivoting mechanism 18 includes the first arm 12 having a transverse curved slot 32 on its inner surface 30 adjacent the handle 14 to form a female socket. The second arm 12 has a transverse curved member 34 on its inner surface 30 adjacent the handle 14 to form a male protrusion which engages with the transverse curved slot 32, and creates a hinge.

Figure 2:
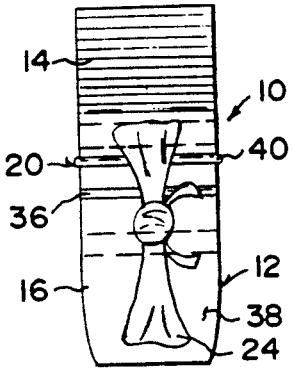
FIG. 2 is an elevational view taken generally in the direction of arrow 2 in FIG. 1.
Figure 3:
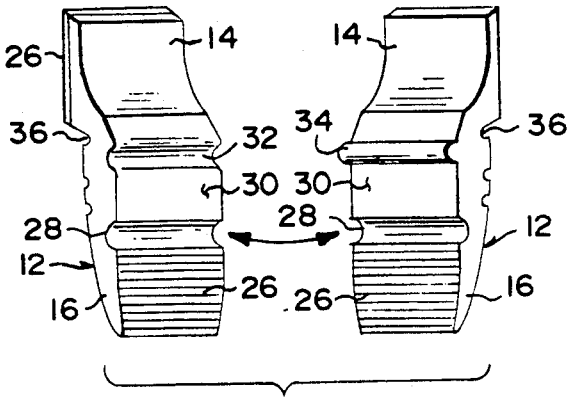
FIG. 3 is a diagrammatic perspective view showing each half of the instant invention separated from each other.
Figure 4:
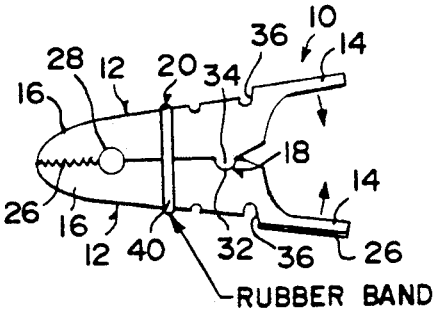
FIG. 4 is a side elevational view taken in the direction of arrow 4 in FIG. 1, illustrating a rubber band biasing mechanism.
Figure 5:
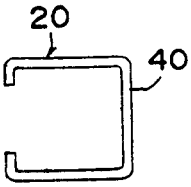
FIG. 5 is a diagrammatic view of a second alternate biasing mechanism.
Figure 7:
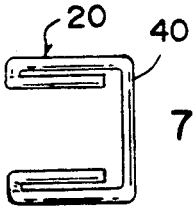
FIG. 7 is a diagrammatic perspective view taken in the direction of arrow 7 in FIG. 6 illustrating just the third alternate biasing mechanism per se.
Figure 6:
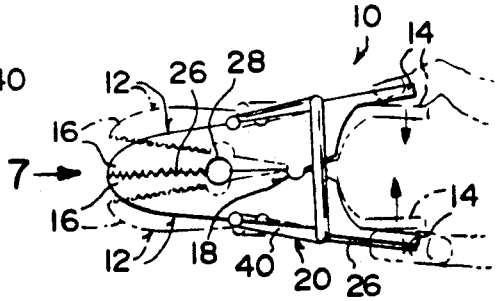
FIG. 6 is a diagrammatic side elevational view illustrating yet a third alternate biasing mechanism.
Figure 10:
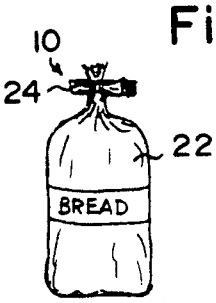
FIG. 10 illustrates the instant invention being used as a closure device typically for a bagged loaf of bread.
Figure 9:
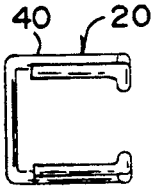
FIG. 9 is a diagrammatic perspective view taken in the direction of arrow 9 in FIG. 8 illustrating just the fourth alternate biasing mechanism per se.
Figure 8:
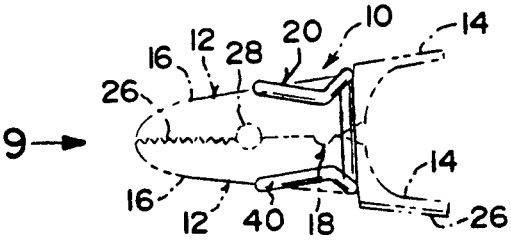
FIG. 8 is a diagrammatic side elevational view illustrating still a fourth alternate biasing mechanism.

The biasing mechanism 20 includes each arm 12 having at least one transverse groove 36 on its outer surface 38 between the handle 14 and the jaw 16. A tension element 40 is provided to engage with the at least one transverse groove 36 on each arm 12. The tension element 40 can be, but not limited to a rubber band shown in FIGS. 1, 2 and 4, or various shaped metal wire spring members shown in FIGS. 5 through 9. The biasing force between jaws can be adjusted by judiciously choosing a particular grooves 36.

To utilize the bag closure clip 10 the following steps should be implemented:

1. Squeeze the handles 14 of the arms 12 together to pivot the arms 12 in the open position to separate the jaws 16.

2. Place the twisted end of the bag 22 between the jaws 16.

3. Release the handles 14 of the arms, so that the arms 12 will move to the closed position, so that the jaws 16 will come together to grip the twisted end of the bag 22 by the teeth 26 or by the transverse gripping hole 28.

While certain novel features of this invention have been shown and described and are pointed out in the annexed claims, it will be understood that various omissions, substitutions and changes in the forms and details of the device illustrated and in its operation can be made by those in the art without departing from the spirit of the invention.

I claim:

1. A bag closure sealing clip which comprises:

a) a pair of elongated arms, each having a handle at a first end and a jaw at a second end, each said jaw including a plurality of teeth and having at least one half of a round transverse bag gripping aperture on it s inner surface fir making an airtight seal on the plastic bag, pivoting means including, said first arm having a transverse curved slot on its inner surface adjacent said handle to form a female socket, and said second arm having a transverse curved member on its inner surface adjacent said handle to form a male protrusion, which engages with said transverse curved slot to form a hinge;

b) means for permitting pivoting of said arms from an open position, in which said jaws are separated to a closed position so that said jaws are together; and c) means for biasing said arms to the closed position, including each said arm having a least one transverse groove on its outer surface between said handle and said jaw; and a resilient tension element for engaging with said at least one transverse groove on each said arm so that said jaws are normally biased together to make an airtight seal on a plastic bag closure mouth with an axis extending transversely thereof and the closure mouth extending between and beyond the jaws, whereby when said handles are manually squeezed together said arms will move into the opened position to separate said jaws and release the airtight seal on the plastic bag, wherein said at least one transverse groove comprises two transverse grooves adjacent the jaws and a single transverse groove adjacent the handle on a side of the rotational axis of the pivot means remote from said two transverse grooves for receiving alternative resilient tension elements.

2. A bag closure sealing clip as recited in claim 1, further including an ornament affixed to one said arm to simulate a tie closure.

3. A bag closure sealing clip as recited in claim 1, further including a magnet member affixed to one said handle, so that said closure clip can be removably attached to a magnetic surface.

4. A bag sealing closure clip as recited in claim 1 wherein the teeth of the jaws are interdigitating.

* * * * *